US005291771A

United States Patent [19]

Tomo et al.

[11] Patent Number: 5,291,771

[45] Date of Patent: Mar. 8, 1994

[54] WIRE BENDING APPARATUS

[75] Inventors: Toshihiro Tomo, Toyota; Hiroyuki Ito, Anjo; Nobumitsu Sakakibara, Kariya, all of Japan

[73] Assignees: Yashawa & Company, Ltd., Tokyo; Sindai Co., Ltd., Aichi, both of Japan

[21] Appl. No.: 11,899

[22] Filed: Feb. 1, 1993

[30] Foreign Application Priority Data

Feb. 3, 1992 [JP] Japan ..... 4-014265[U]

[51] Int. Cl.[5] ..... B21D 7/024

[52] U.S. Cl. ..... 72/306; 72/307; 72/422

[58] Field of Search ..... 72/306, 307, 420, 421, 72/422

[56] References Cited

U.S. PATENT DOCUMENTS

| | | | |
|---|---|---|---|
| 3,245,433 | 4/1966 | Taylor, Jr. . | |
| 3,894,048 | 4/1975 | Millar et al. | 72/422 |
| 4,388,039 | 6/1983 | Schwarze | 72/422 |
| 4,662,204 | 5/1987 | Saegusa | 72/306 |
| 4,945,747 | 8/1990 | Yogo | 72/306 |
| 4,967,472 | 11/1990 | Ebihara et al. | 29/797 |
| 5,113,683 | 5/1992 | Lafrasse | 72/306 |

FOREIGN PATENT DOCUMENTS

| | | | |
|---|---|---|---|
| 0032656 | 7/1981 | European Pat. Off. | 72/307 |
| 0141745 | 5/1985 | European Pat. Off. . | |
| 0445044 | 9/1991 | European Pat. Off. . | |
| 3236663 | 7/1983 | Fed. Rep. of Germany . | |
| 2230215 | 10/1990 | United Kingdom . | |

*Primary Examiner*—David Jones

*Attorney, Agent, or Firm*—Wenderoth, Lind & Ponack

[57] ABSTRACT

A wire bending apparatus includes both a robot provided with a device for gripping and rotating a wire, and a suitable number of program-controlled benders. The robot grips a wire and supplies a portion of the wire to be bent to the program-controlled benders. The robot is rotated through a predetermined angle while gripping the wire according to a direction in which a next portion of the wire is to be bent, after which the wire is supplied to the program-controlled bender to bend the wire such that the wire is ultimately bent into a predetermined shape.

8 Claims, 5 Drawing Sheets

WIRE BENDING APPARATUS

BACKGROUND OF THE INVENTION

1. Field of the Invention

The present invention relates to a wire bending apparatus.

2. Description of the Related Art

At present, there are various wire bending machines such as an NC bender, an exclusive-use machine, and so on.

FIG. 1 shows one example of an NC bender, in which one end of a workpiece 1 (a wire) is held by a work chuck 2, the work chuck 2 is advanced (moved leftward in FIG. 1) to set the workpiece 1 against a bending segment 3, a fixed clamp 4 and a movable clamp 5 are actuated, and the movable clamp 5 is rotated in a direction indicated by an arrow to bend the workpiece 1. These operations are subjected to NC control. A bending angle and a bending direction are set by the amount of rotation of the movable clamp and rotation of the work chuck 2, respectively.

FIGS. 3(*a*) and 3(*b*) show an exclusive-use apparatus for bending a workpiece 1 into a crank as exemplified in FIG. 2. Workpieces 1 are taken out by carrier loaders 6 and are successively transferred to exclusive-use benders 7 for bending thereof.

SUMMARY OF THE INVENTION

An NC bender used at present for producing a variety of shapes of wire in a small quantity cannot readily bend opposite ends of the wire and cannot automatically supply a set of wire workpieces without the intermediary of separate equipment, thus requiring an operator. Since separate equipment (a loader and an unloader) are required, an initial production cost is high. Further, set and offset equipment, and a layout space and a space through which the workpieces must be swung require a large amount of equipment space.

On the other hand, in the exclusive use machine, the number of processes is great, the initial cost of equipment is high, the required space is large, and the control of the attitude of a workpiece is complicated. In addition, when adjusting the amount by which a wire workpiece is to be bent, each exclusive use bender 7 has to be readjusted. This takes a large amount of preparation time.

It is an object of the present invention to provide a wire bending apparatus which is free from the problems noted above.

The present invention has been proposed in order to achieve the aforesaid object. The apparatus of the present invention comprises a robot provided with a robot hand having a device which grips and rotates a wire, and one or two program-controlled benders. In the apparatus of the present invention, space for equipment and safety measures have been taken into consideration, and products are continuously processed without releasing the workpiece. Furthermore, the features of a multi-articulated robot are exploited so that when separate units (a secondary working unit, a tertiary working unit, etc.) are arranged at the periphery thereof, multipurpose products can be worked without a large amount of manual labor.

Since the present invention uses the robot, operations from work-set to offset can be automatically carried out. Since the robot hand functions to rotate a wire, it can facilitate the bending of a wire in a suitable direction, at a suitable angle and of suitable dimensions as well as carry out the normal function of the robot itself. Even in the case where the bending to be carried out is complex, such various shapes of bent wire products can be manufactured by changing the program.

DETAILED DESCRIPTION OF THE PREFERRED EMBODIMENTS

Figure 1:
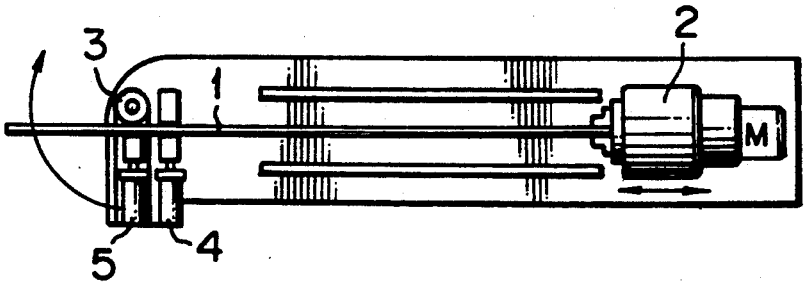
FIG. 1 PRIOR ART
FIG. 1 is a plan view of a conventional NC bender.
Figure 2:
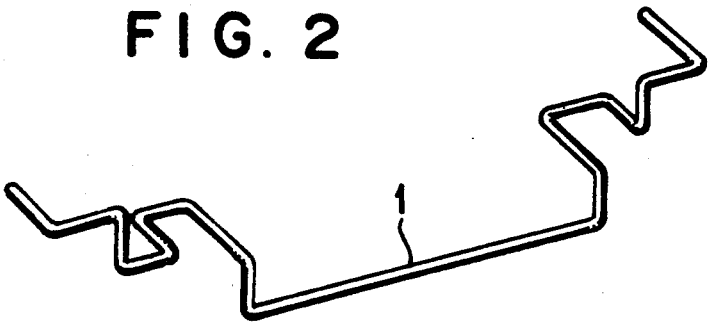
FIG. 2 is a perspective view showing an example of a bent workpiece.
Figure 3A:
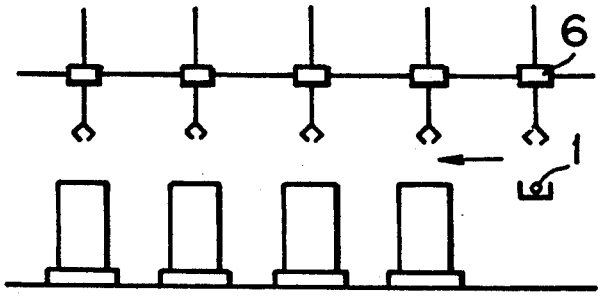
FIG. 3(a) PRIOR ART
FIGS. 3(*a*) and 3(*b*) are schematic diagrams of a conventional exclusive use machine.
Figure 3B:
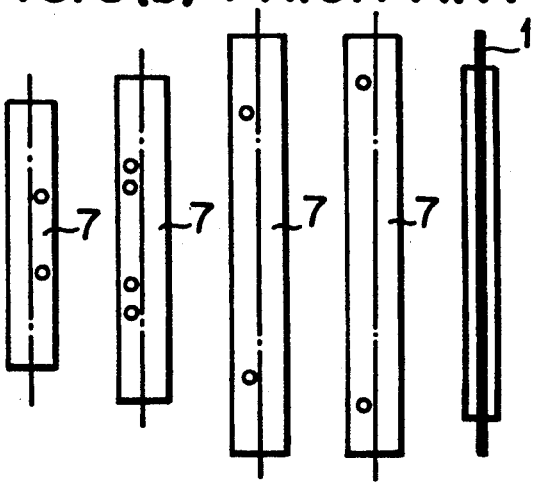
FIG. 3(b) PRIOR ART
Figure 4:
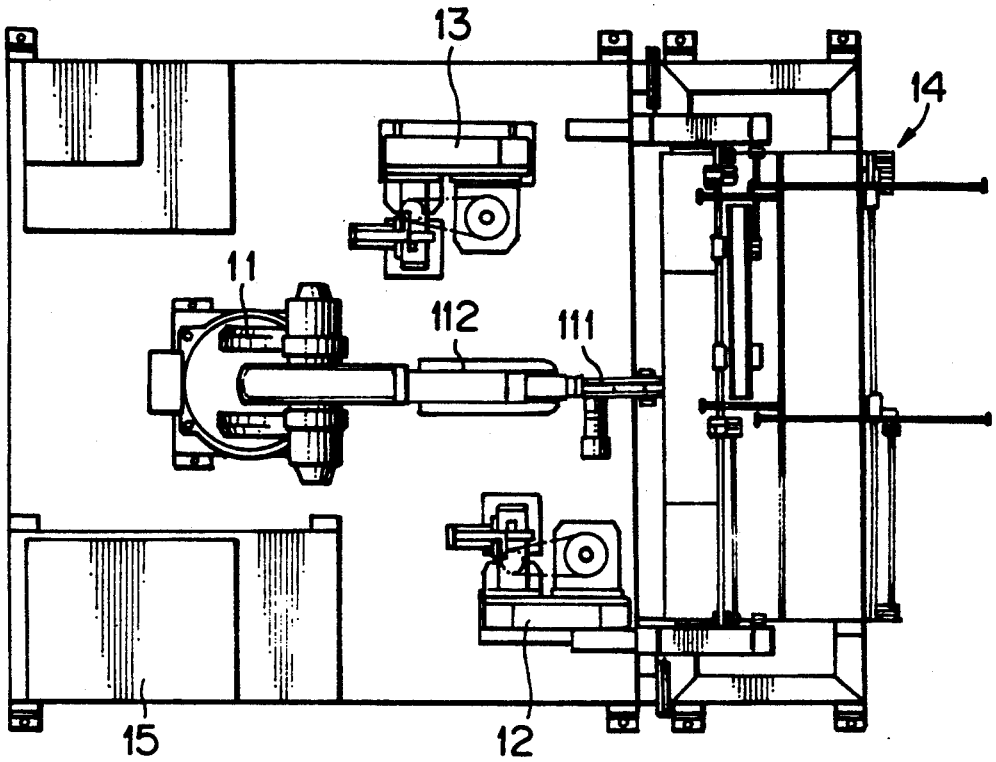
FIG. 4 is a plan view of an embodiment of a wire bending apparatus according to the present invention.
Figure 5:
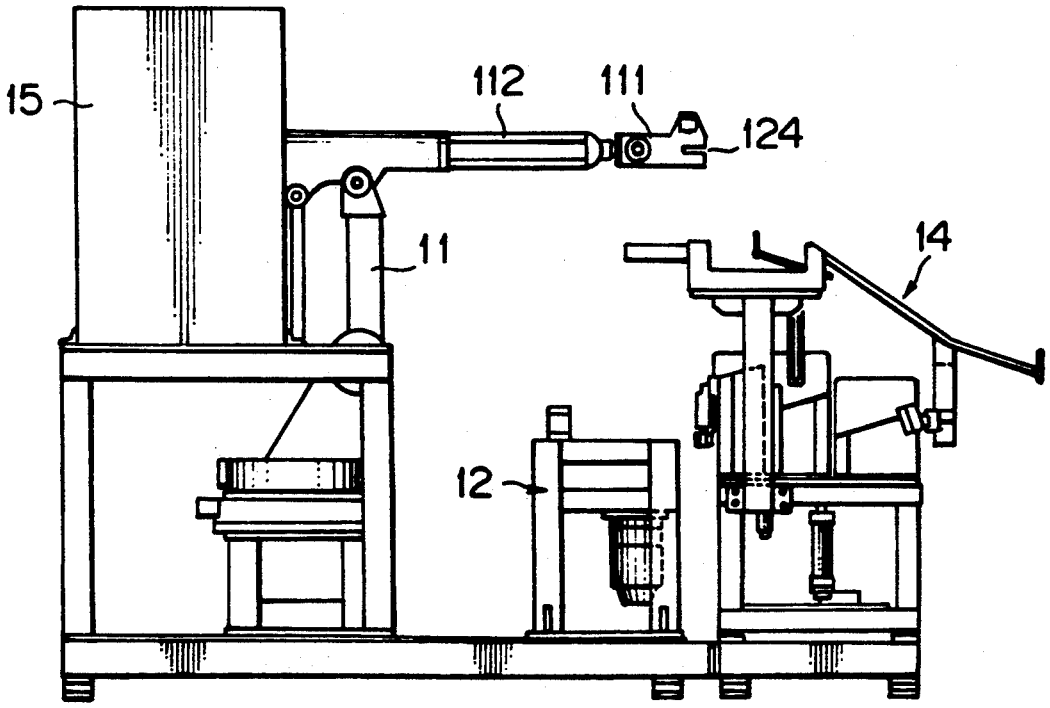
FIG. 5 is a side view of the same with a part shown in FIG. 4 omitted.

Referring to FIG. 4 and FIG. 5, reference numeral designates a multi-articulated robot, 12 and 13 program-controlled benders, 14 a work chute, and 15 a control panel.

For better understanding, FIG. 5 omits one program-controlled bender 13.

Figure 6:
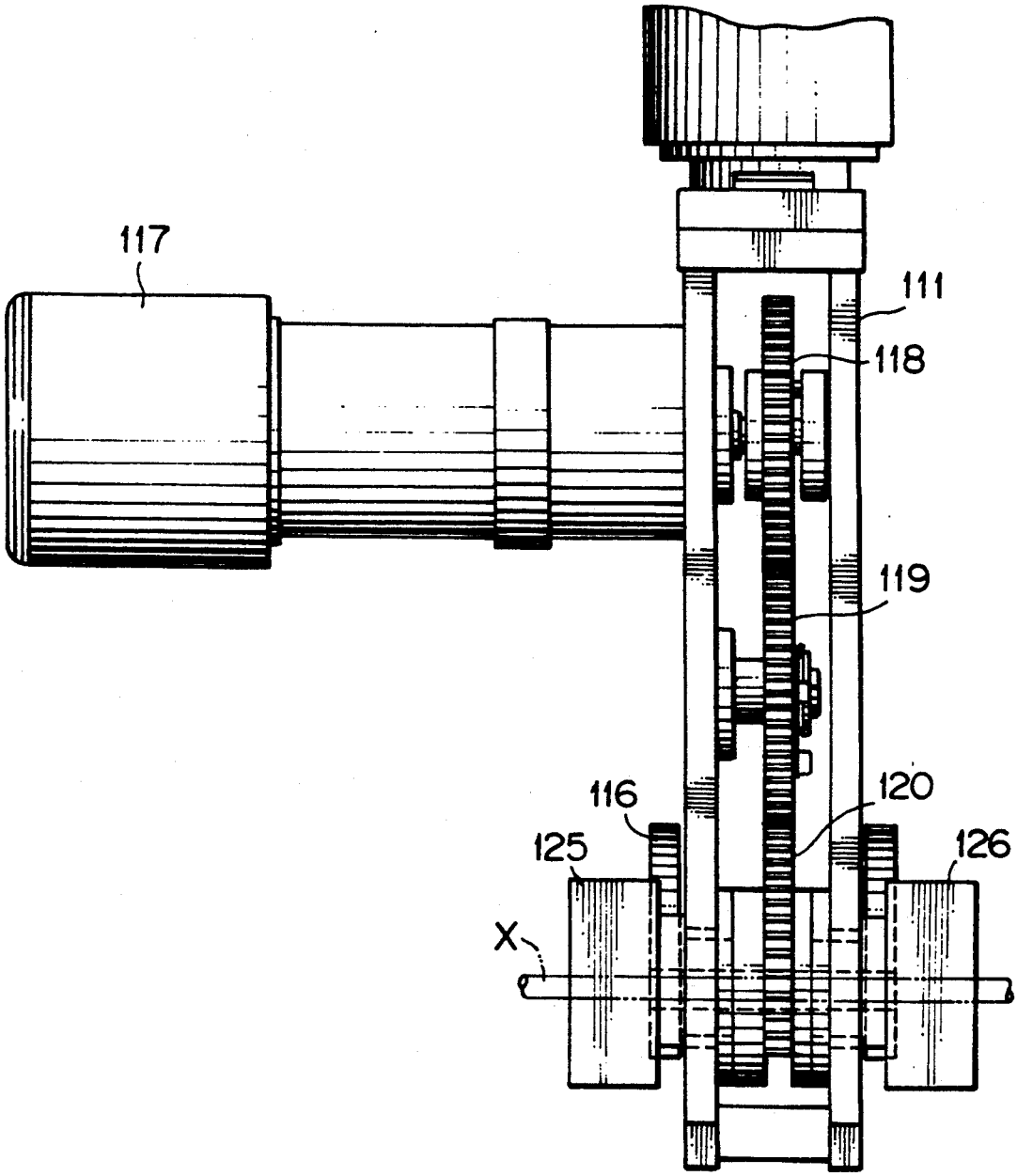
FIG. 6 is an enlarged plan view of a robot hand.
Figure 7:
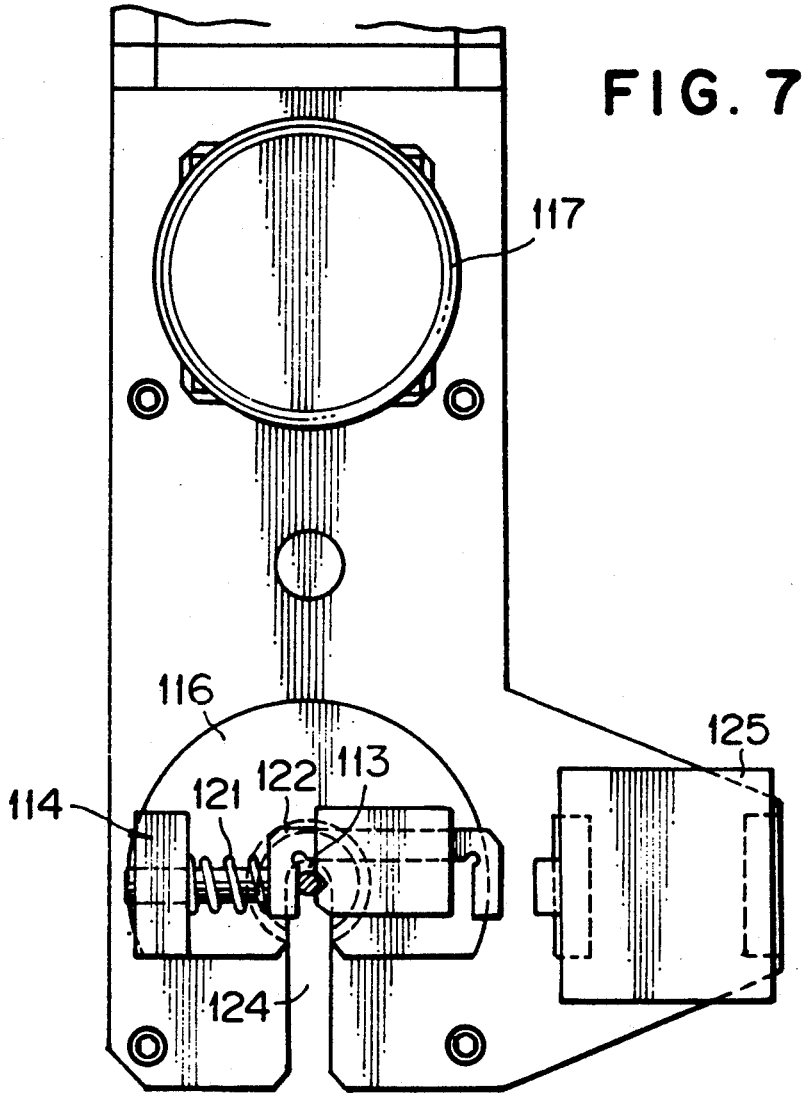
FIG. 7 is a left side view of the robot hand.
Figure 8:
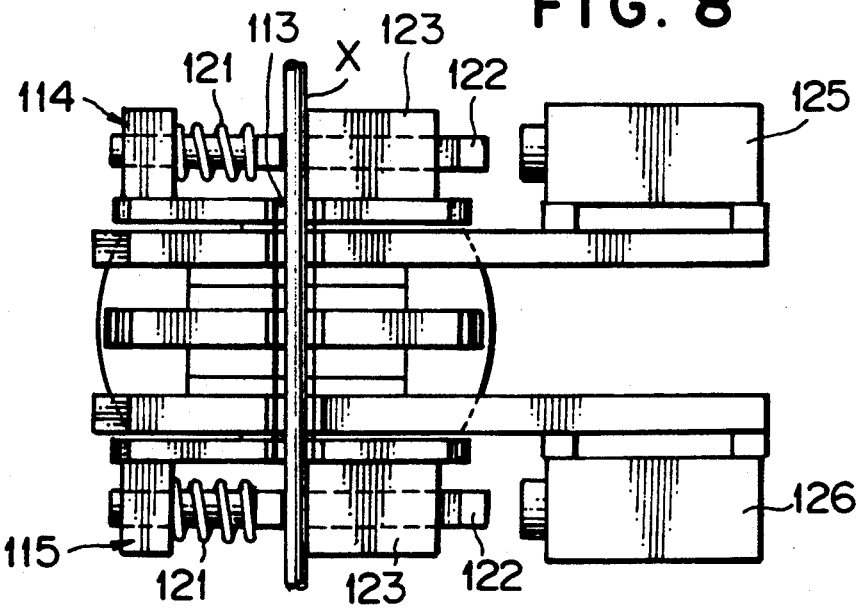
FIG. 8 is a bottom view of the robot hand.

FIG. 6 is an enlarged plan view of a robot hand 11, FIG. 7 is a left side view thereof, and FIG. 8 is a bottom view.

The robot hand 111 can be raised and lowered with respect to a robot arm 112 and rotated, similarly to a conventional robot hand, and functions to grip and rotate a wire X.

More specifically, a rotary body 116 provided with a wire inserting groove 113 and wire gripping devices 114 and 115 on both sides thereof is provided at the end of the robot hand 111. The rotary body 116 is rotated by a control motor 117 through a first gear 118, a second gear 119 and a third gear 120. The wire gripping devices 114 and 115 are designed so that a movable clamp 122 is biased toward a fixed clamp 123 by a coil spring 121. A wire guide groove 124 and air cylinders 125 and 126 for pushing back the movable clamp 122 against the coil spring 121 are provided at the end of the robot hand 111. When a wire is gripped and when a wire is released, the air cylinders 125 and 126 are actuated, and when a wire X is bent, the wire X is gripped by the movable clamp 122 and the fixed clamp 123 by virtue of the force of the coil spring 121.

Accordingly, the wire X can be rotated by a suitable angle of rotation by controlling the control motor 117, and the wire X can be gripped or released by controlling the air cylinders 125 and 126.

Figure 9:
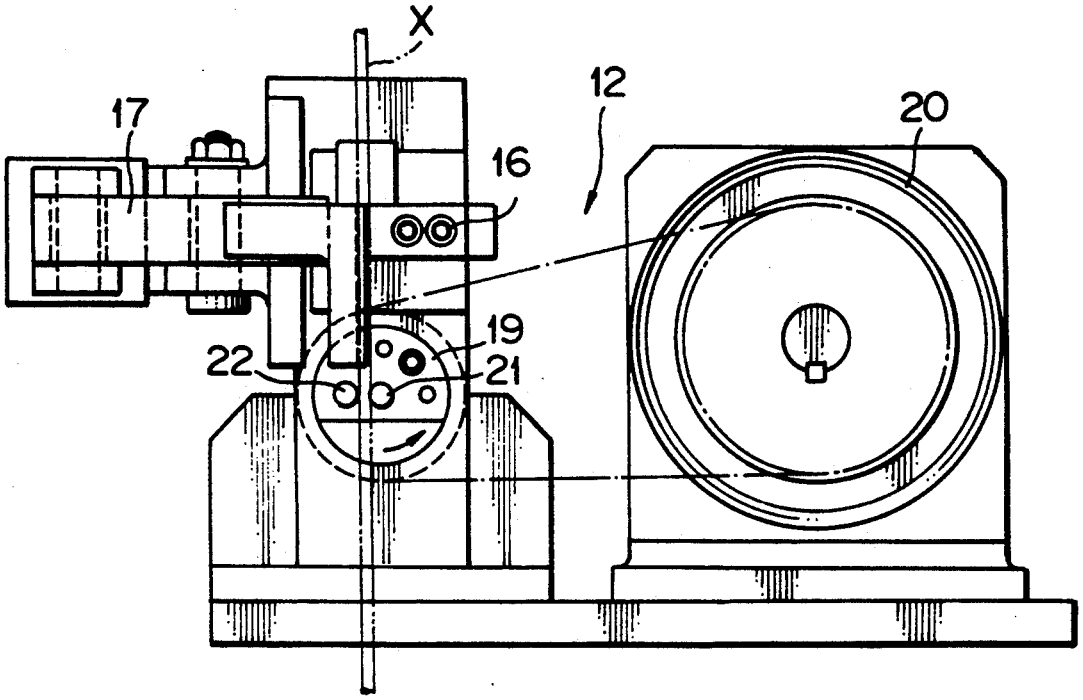
FIG. 9 is a plan view of a program-controlled bender in the embodiment.
Figure 10:
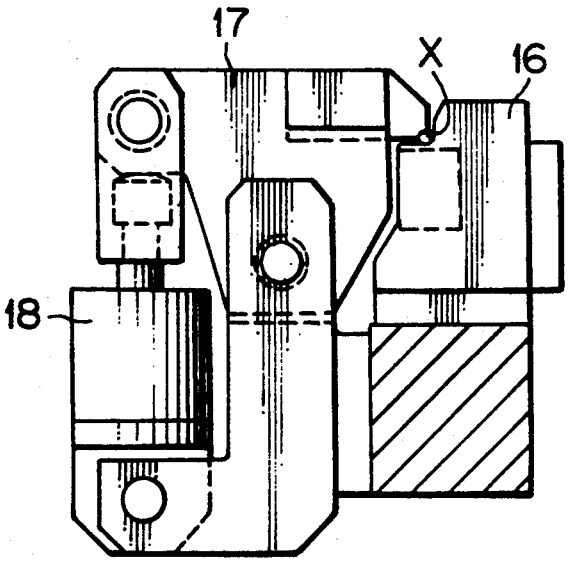
FIG. 10 is a side view of the bender with a part shown in FIG. 9 omitted.

FIG. 9 is an enlarged plan view of the program-controlled bender 12, and FIG. 10 is a side view thereof with a part cutaway. Reference numeral 16 designates a fixed clamp jig, 17 a movable clamp jig driven by a hydraulic cylinder 18, and 19 a rotary segment (a bending jig) provided with two bending pins 21 and 22 and driven by the control servo motor 20. These elements constitute a single preparation type jig adjusted to products to be processed. One bending pin 21 is provided at the rotational center of the rotary body 19.

Accordingly, the wire X is set between the bending pins 21 and 22, the wire X is gripped by the movable clamp jig 17 driven by the hydraulic cylinder 18 and the fixed clamp jig 16, and thereafter the rotary segment 19 is rotated by the control servo motor 20 to thereby bend the wire X.

A bending angle can be suitable decided by the control of the control servo motor 20.

In the wire bending apparatus according to the present invention, an unworked wire X (a workpiece) is placed on an inlet portion A of a wire chute 14, and the robot 11 is program-controlled so that the wire X is picked up by the robot hand 111, the end of the wire X is moved to the program-controlled benders 12 and 13 on both sides of the robot 11 and the wire X is inserted into the program-controlled benders 12 and 13 by movement of the robot 11 and the rotation of the robot hand 111. Subsequently, the complicated bending of the wire X is executed.

After completion of the bending working, the robot 11 drops the wire X on an outlet portion B of the wire chute 14 to complete the bending operation.

While in this embodiment, two benders are provided so that both ends of the wire are worked by separate benders, it is to be noted that since the robot hand 111 can be raised and lowered with respect to the arm and can be rotated, similar bending can be carried out even by one bender.

While in the aforementioned embodiments, the case has been described in which the robot hand 111 is mounted on an arm of the multi-articulated robot, it is obvious that similar bending working can be carried out even if another type of robot arm supports the robot hand 111.

According to the present invention, bending of the workpiece into various kinds of shapes can be carried out merely by changing a program. Further, the apparatus can be installed in a space which is far narrower than that of the conventional exclusive use machine. Moreover, accessories such as a loader and an unloader are not required. Furthermore, a smaller area in which it is necessary to swing the products is required. In addition, the invention is safer to use than the conventional NC bender and the exclusive use machine.

Moreover, there is an advantage in that a specialist (a high class technician) is not required for operating the equipment.

What is claimed is:

1. A wire bending apparatus comprising: the combination of a robot and at least one program-controlled wire bender discrete from said robot, said robot including a robot hand comprising a rotary body having opposite sides and a groove open at said opposite sides and into which groove a wire is insertable, wire gripping devices disposed at the opposite sides of said rotary body, respectively, and a control motor operatively connected to said rotary body so as to rotate the rotary body, each of said gripping devices including a fixed clamp fixed relative to said rotary body, a movable clamp, a spring exerting an urging force that biases said movable clamp toward the fixed clamp such that a wire received in said groove will normally be gripped by said fixed and movable clamps, and means for moving the movable clamp away from the fixed clamp against the urging force exerted by said spring.

2. A wire bending apparatus as claimed in claim 1, wherein said robot is multi-articulated.

3. A wire bending apparatus as claimed in claim 1, wherein each said program-controlled wire bender includes a rotary segment, elements by which a wire can be fixed relative to said rotary segment, and a motor operatively connected to said rotary segment so as to rotate the rotary segment.

4. A wire bending apparatus as claimed in claim 2, wherein each said program-controlled wire bender includes a rotary segment, elements by which a wire can be fixed relative to said rotary segment, and a motor operatively connected to said rotary segment so as to rotate the rotary segment.

5. A wire bending apparatus as claimed in claim 1, wherein each said wire bender is fixed in position in the apparatus.

6. A wire bending apparatus as claimed in claim 2, wherein each said wire bender is fixed in position in the apparatus.

7. A wire bending apparatus as claimed in claim 3, wherein each said wire bender is fixed in position in the apparatus.

8. A wire bending apparatus as claimed in claim 4, wherein each said wire bender is fixed in position in the apparatus.

* * * * *